United States Patent [19]

Ikeda

[11] 4,301,615

[45] Nov. 24, 1981

[54] TOY HAVING MEMBER CAPABLE OF GOING FROM A FIRST POSITION TO A SECOND POSITION AND AUTOMATICALLY RETURNING TO THE FIRST POSITION

[75] Inventor: Masaki Ikeda, Tokyo, Japan

[73] Assignee: Tomy Kogyo Co., Inc., Tokyo, Japan

[21] Appl. No.: 100,892

[22] Filed: Dec. 6, 1979

[30] Foreign Application Priority Data

Dec. 7, 1978 [JP] Japan ..... 53-151823

[51] Int. Cl.[3] ..... A63H 13/02

[52] U.S. Cl. ..... 46/105

[58] Field of Search ..... 46/4, 5, 92, 103, 104, 46/105, 235, 264, 265, 266, 268

[56] References Cited

U.S. PATENT DOCUMENTS

| | | | |
|---|---|---|---|
| 379,607 | 3/1888 | Rex | 46/5 |
| 862,015 | 7/1907 | Pittman | 46/105 |
| 1,561,374 | 11/1925 | Sweet | 46/105 |
| 3,462,880 | 9/1967 | Tomaro . | |
| 3,688,435 | 9/1972 | Sapkus et al. | |
| 4,068,401 | 1/1978 | Saitoh . | |

FOREIGN PATENT DOCUMENTS

| | | | |
|---|---|---|---|
| 697736 | 11/1930 | France | 46/104 |
| 980073 | 12/1950 | France | 46/4 |

*Primary Examiner*—F. Barry Shay

*Attorney, Agent, or Firm*—K. H. Boswell; Edward D. O'Brian

[57] ABSTRACT

A toy has a body in the shape of a characterized animal. At least one of the extremities, preferably the head, is attached to a movable member which moves between a retracted position wherein the majority of the member is located inside the body to an extended position wherein the greatest portion of the member is located external of the body. The toy includes a mechanism which will move the member from its extended position to its retracted position upon activation of a mechanism at least a portion of which is exposed outside the body for manipulation by the operator. The member in going from its extended position to its retracted position reaches its retracted position and then automatically reverses itself until it is once again extended.

12 Claims, 8 Drawing Figures

18
50-b
48-b
120b
24-b
104
50-c
48-c
120c
24-c
16
22
92
102
54
128
124
48-c
120-c
120c
24-a
48-a
50-a
120-a
112
118
20
122
116
126
124
132
100
106
78
96
108
138
128

4
18
20
122
124
126
48-a
50-a
24-a
120-a
24-b
120-b
50-b
48-b
104
116
152
154
118
112
130
120a
24-d
48-d
50d
108
102
100
156
120-c
24-c
96
128
132
78
48-c
50-c
106
16
22

7
7
124
126
166
154
100
30
26
28
116
160
104
156
136
64
54
62
24-b
34
36
60
52
68
70
66
44
38
16
58
92
90
94
82
80
74
76
86
128
56
96
78
106
102
14
32
22

TOY HAVING MEMBER CAPABLE OF GOING FROM A FIRST POSITION TO A SECOND POSITION AND AUTOMATICALLY RETURNING TO THE FIRST POSITION

BACKGROUND OF THE INVENTION

This invention is related to a toy which has a major extremity which is normally in an extended position. A mechanism is provided on the toy allowing the user of the toy to touch a button on the toy causing the major extremity to retract into the toy and then automatically extend again. When the major extremity again reaches its extended position minor extremities are activated and remain activated until the major extremity is once again retracted.

Different types of toys have different appeals to different ages. The small child will be quite fascinated with a rather immobile toy such as a teddy bear or the like. The older child is able to comprehend much more and prefers toys which are more complicated. The preschooler lies somewhere in between. A preschooler toy cannot be too complicated or the toy overwhelms the child. However, since during this age period the child's mind is rapidly expanding the preschooler is capable of being fascinated by and therefore having an extended time span occupation of the toy that has some sort of action incorporated into the toy.

Many toys which are characterized animals are known. These toys have a variety of mechanical responses such as jiggling up and down when being pushed, etc. Turtle toys have a large latitude for the designer in that the natural action of the turtles in being able to extend and retract their heads and/or extremities can lead to many different possible combinations of interaction of movement of the toy and movement of the component parts of the turtle. Of the turtle toys that are known none are known to have the ability to function both on a hard surface and in a body of water and to simultaneously be able to retract their head and extremities and also to propel themselves both over the hard surface and the body of water.

SUMMARY OF THE INVENTION

It is a broad object of this invention to provide a toy which fulfills the criteria outlined in the preceding paragraph. It is a further object to provide a toy which is capable of withstanding the abuse given to a toy by the normal preschooler but is still capable of doing all the different functions described above. It is a further object to provide a toy that because of its design and engineering is economical to manufacture and thus readily accessible to a large segment of the preschool population.

These and other objects as will be evident from the remainder of this specification are achieved by providing a toy which comprises: a body having a characterized motif of an animal and including at least one movable member located in association with the body which is capable of moving between a retracted position wherein most of the member is located within the body of the toy and an extended position wherein at least that portion of the movable member which mimics a body part is extended outwardly from the body of the toy; operatively associated with the movable member is a retraction means capable of causing the movable member to move from the extended position to the retracted position and which includes a retraction activation means at least a portion of which is exposed outside the body so as to be positioned to be operated by the user of the toy, said retraction activation means is capable of activating said retraction means to move said movable member to said retracted position; associated with the movable member is an automatic extension means which is capable of sensing when said movable member is in said retracted position and in response to move said movable member automatically back to the extended position.

The toy can also include at least one but preferably several motion means movably attached to said body and capable of moving with respect to the body; a motor means for activating said automatic extension means in addition to a motion activation means which in turn causes movement of the motion means when the movable member is in the extended position.

When several motion means are included in the toy they would include a rolling means for moving the toy across a surface and a plurality of movable extremities shaped in the theme of the animal. Further an aquatic propulsion means is connected to the motor means for propelling the animal in a body of water.

BRIEF DESCRIPTION OF THE DRAWINGS

This invention will be better understood when taken in conjunction with the drawings wherein.

Figure 1:
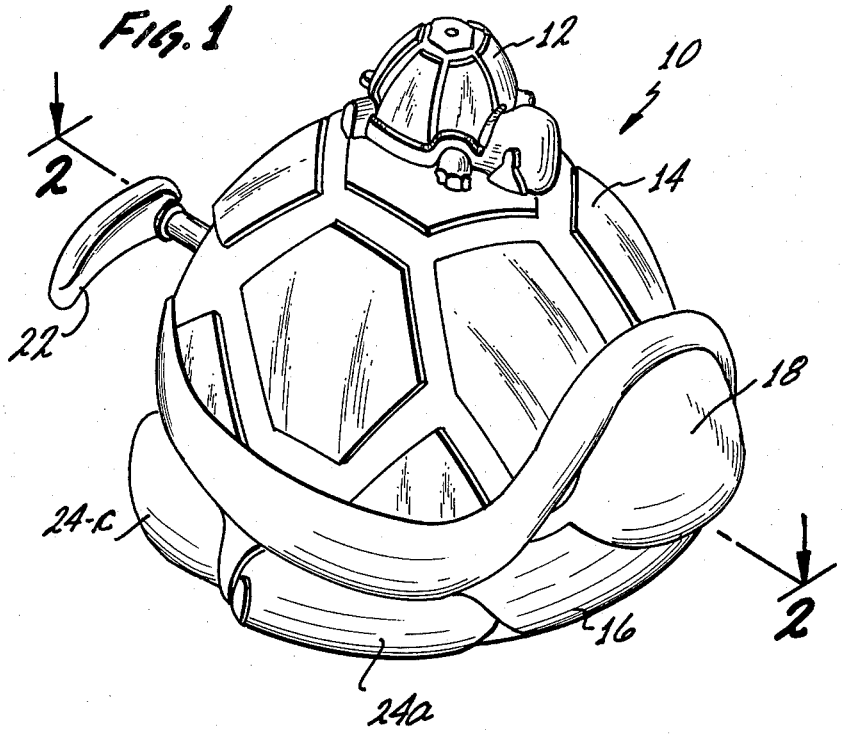
FIG. 1 is an isometric view of the toy of this invention showing the toy in a retracted position.

The invention described in this specification and illustrated in the drawings utilizes certain principles and concepts as are set forth and claimed in the claims appended to this specification. Those skilled in the art to which this invention pertains will realize that these principles and/or concepts can be used with a variety of differently appearing embodiments. For this reason this invention is not to be construed as being limited to the exact embodiment herein described but is to be construed in light of the claims.

DETAILED DESCRIPTION

Figure 2:
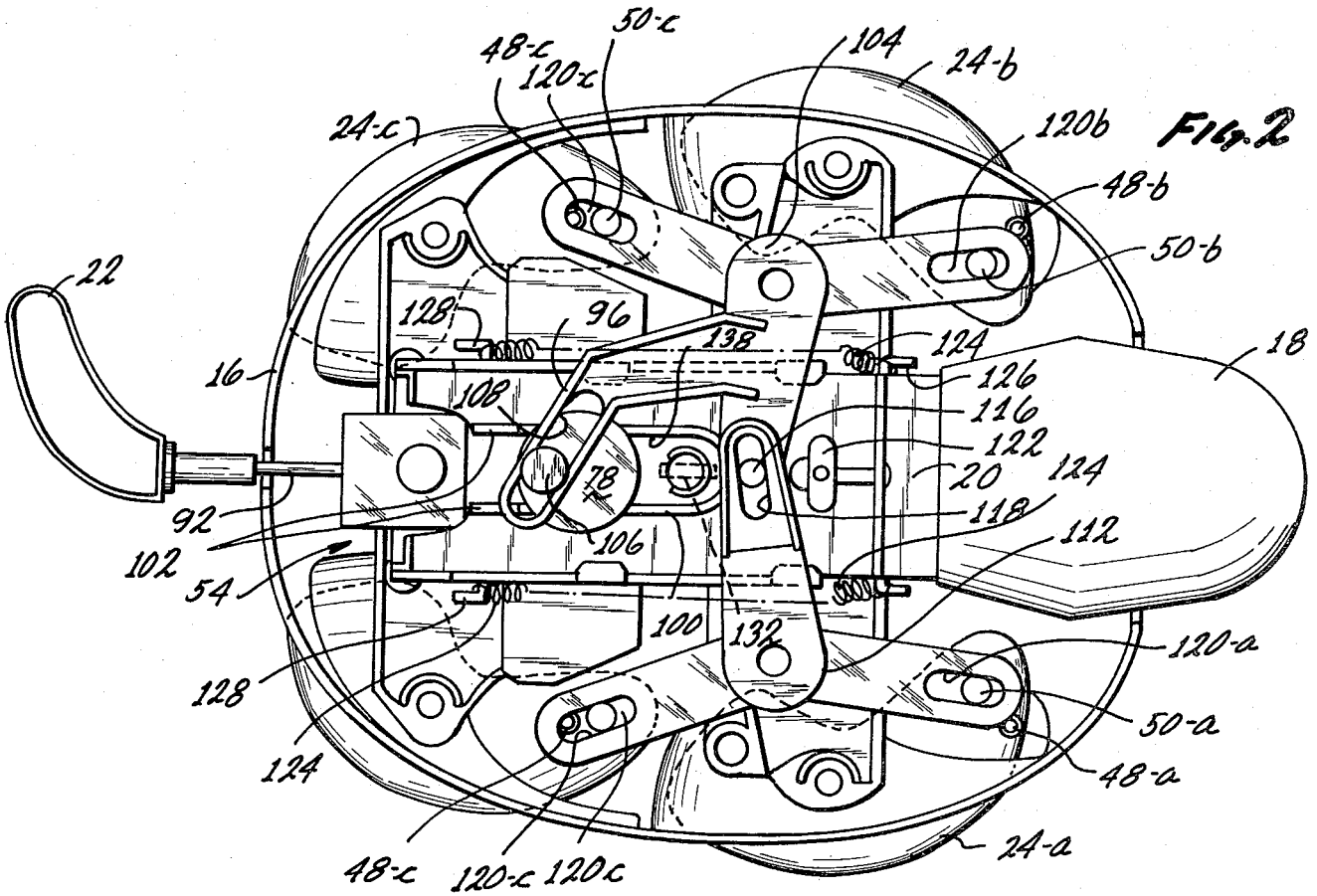
FIG. 2 is a top plan view about the line 2—2 of FIG. 1.
Figure 3:
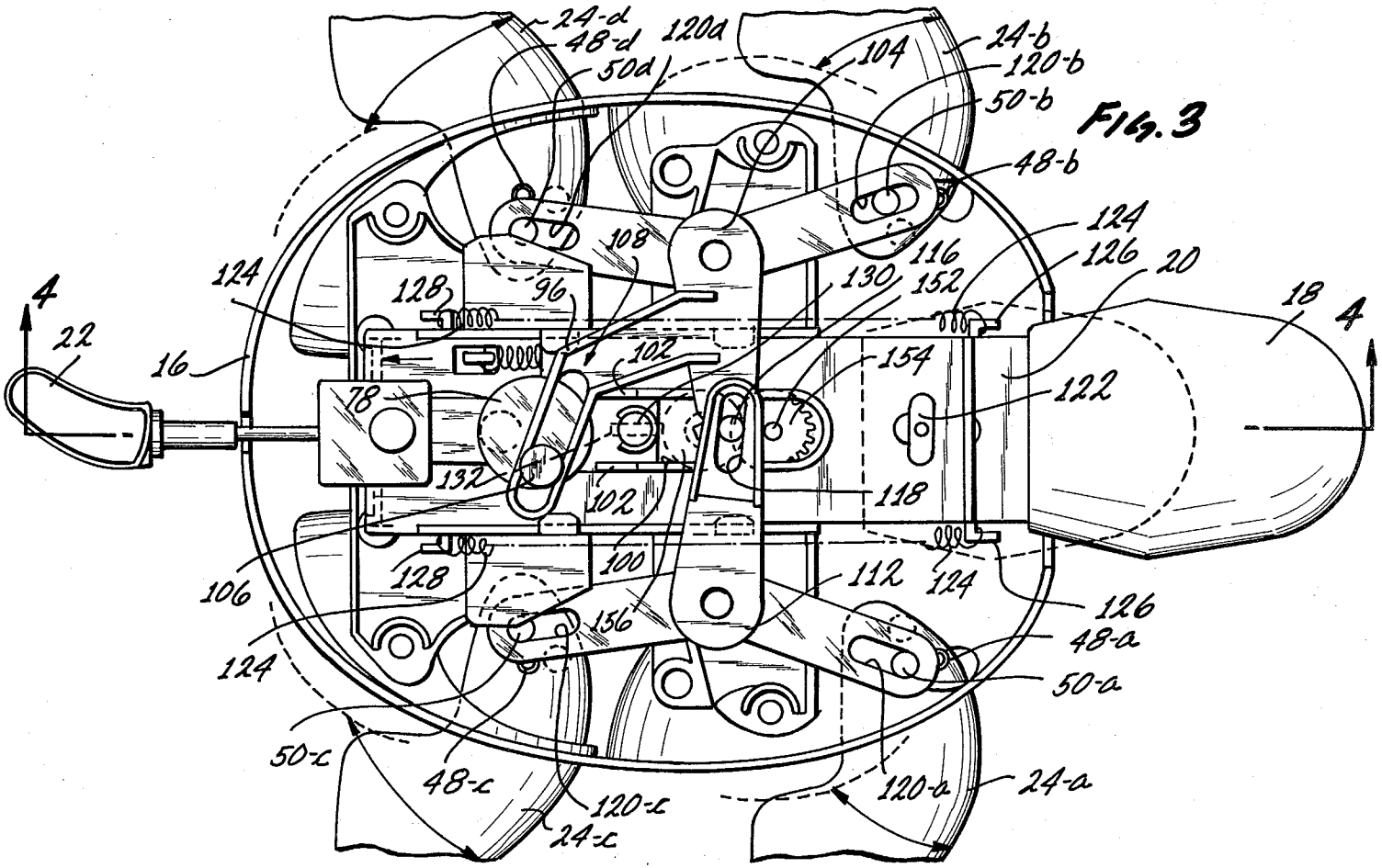
FIG. 3 is a top plan view similar to FIG. 2 except showing certain of the components of the invention in a different spatial relationship to that shown in FIG. 2.

The toy 10 of the invention is shaped like a characterized turtle with a small turtle 12 riding on its back. The toy 10 has an upper housing 14 shaped as a turtle shell and a bottom housing 16 mating therewith. Projecting out of the front of the toy 10 is a head 18 which in fact is the outermost extension of a movable member 20. Projecting out of the rear end of the toy 10 is a tail 22 which has a blade shape enabling the tail 22 to propel the toy 10 through water when the tail 22 spins as hereinafter described. Four legs 24 *a, b, c* and *d* project out of the side of the toy 10 beneath the upper housing 14. The legs 24 are movable between a retracted position wherein they fit snugly against the bottom housing 16 as seen in FIG. 2 and an extended position where they are displaced outwardly as seen in FIG. 3.

The small turtle 12 is mounted to a shaft 26 which projects through the upper housing 14. A compression spring 28 fits around shaft 26 and biases the small turtle 12 upwardly within the upper housing 14. A sleeve 30 fits over shaft 26 and includes a finger 32 integrally formed with the sleeve 30. When the small turtle 12 is depressed against the bias of spring 28 the motion is transferred via shaft 26 to sleeve 30 and finger 32. This motion is further conveyed by finger 32 as hereinafter described.

Attaching to bottom housing 16 is a front axle 34. A single front wheel 36 is mounted on axle 34. A portion of the wheel 36 extends below the bottom housing 16 and serves as a partial support for the toy 10. A rear axle 38 is journaled in bottom housing 16 in approximate bearing surfaces (not numbered) and carries on it two rear wheels 40 and 42. The rear wheels 40 and 42 support the remainder of the toy 10.

Both rear wheels 40 and 42 are fixedly attached to axle 38. A crown and spur gear 44 integrally formed together are freewheeling about axle 38 proximal to rear wheel 42. Projecting toward the center of rear wheel 42 are two ratchets 46 which are located and in communication with the spur gear portion of gear 44. Together the ratchet 46 and the spur gear portion of gear 44 serve as a clutch to prevent damage to the internal mechanisms as hereinafter described should the user of the toy 10 push the toy 10 across the surface rotating the rear wheels 40 and 42.

The legs 24 are each pivotally mounted about an axle 48 *a, b, c* and *d* projecting upwardly from bottom housing 16. Each of the legs 24 has an upstanding boss 50 *a, b, c* and *d* projecting upwardly near the axle 48. As hereinafter described motion of other components of the toy are conveyed to the bosses 50 which cause the legs 24 to retract and extend between their two different positions shown in FIGS. 2 and 3.

Located on the bottom of bottom housing 16 is a winding knob 52. The winding knob 52 is linked to a spring motor (not separately numbered) as hereinafter described and is used to energize the spring motor. The winding knob 52 is accessible to the fingers of a user of a toy but is located where it is out of sight when the toy is in use.

Figure 4:
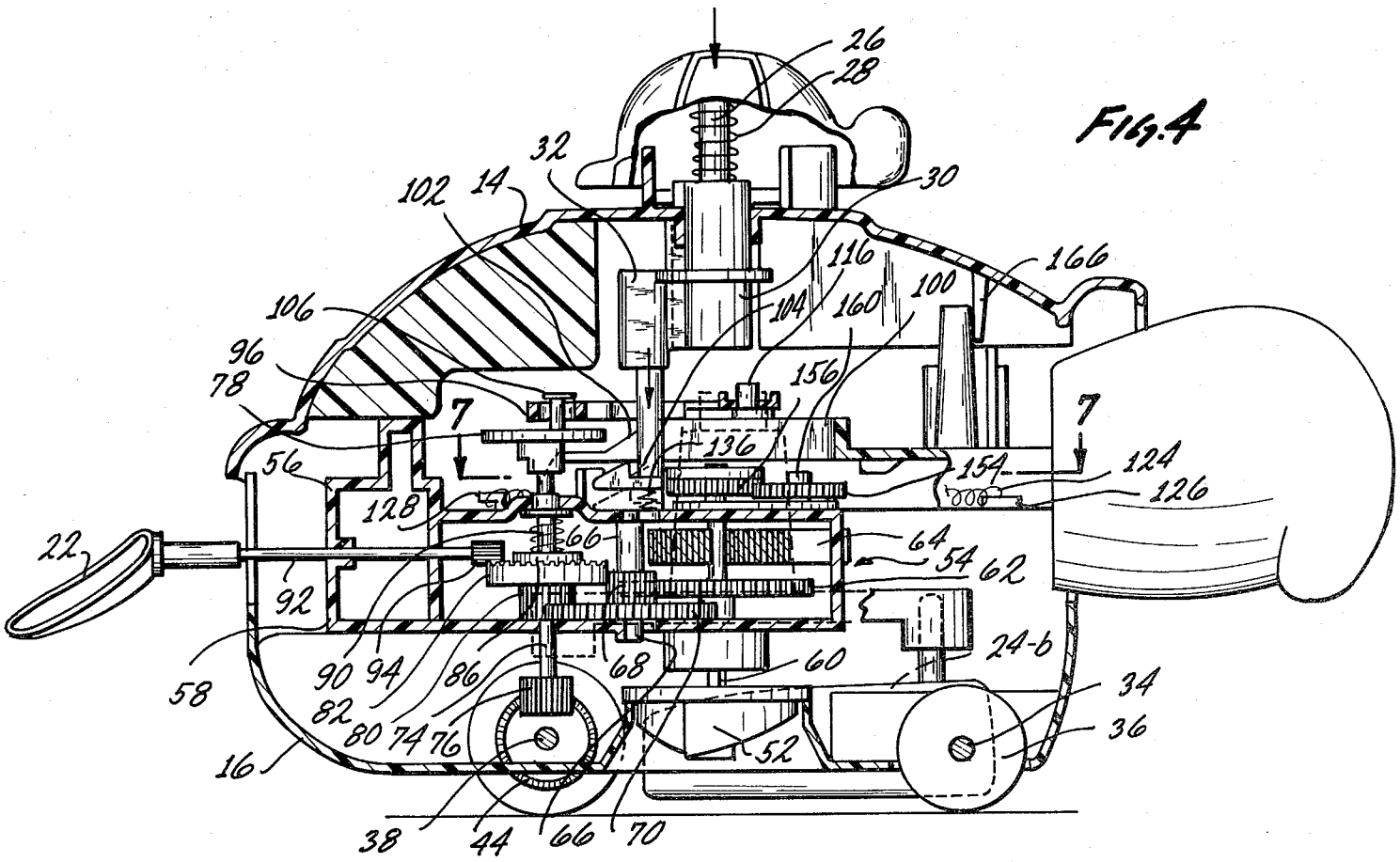
FIG. 4 is a side elevational view in partial section taken about the line 4—4 of FIG. 3.
Figure 5:
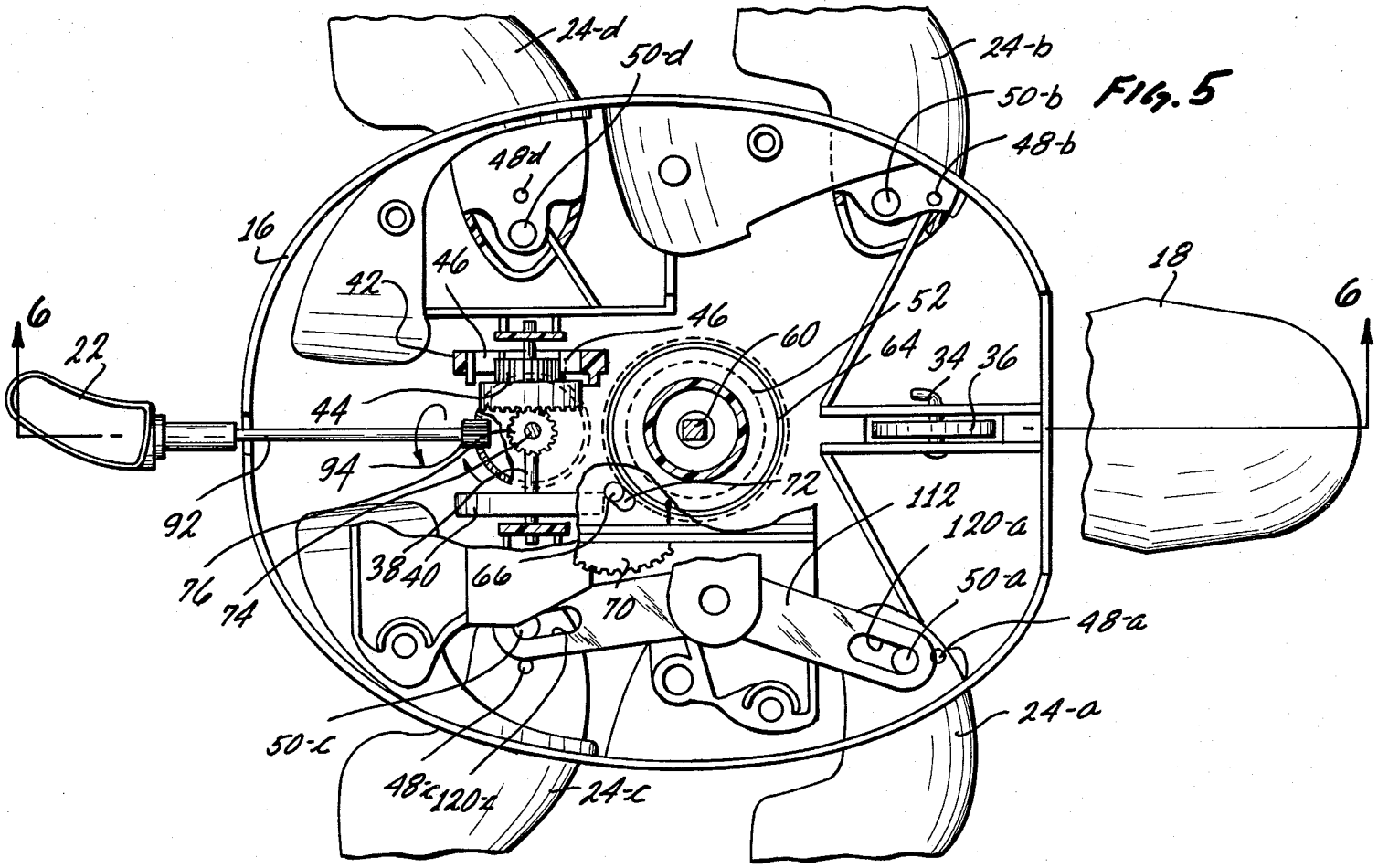
FIG. 5 is a top plan view in partial section similar to FIG. 3 except certain overlying components which are shown in FIG. 3 have been removed to expose components beneath them.

In order to better understand the function of the internal mechanical components a brief description of how the toy operates is as follows: The user of the toy energizes the motor by winding the winding knob 52. The toy is then set down either on a surface or in water. The tail 22 spins continuously and the head 18 extends outwardly from its retracted position within the upper housing 14. When the head 18 reaches its limit of extension as shown in FIGS. 3, 4 and 5 the legs 24 are activated and they rapidly move in and out of the bottom housing 16 between the positions shown in FIGS. 2 and 3.

Figures 6, 7:
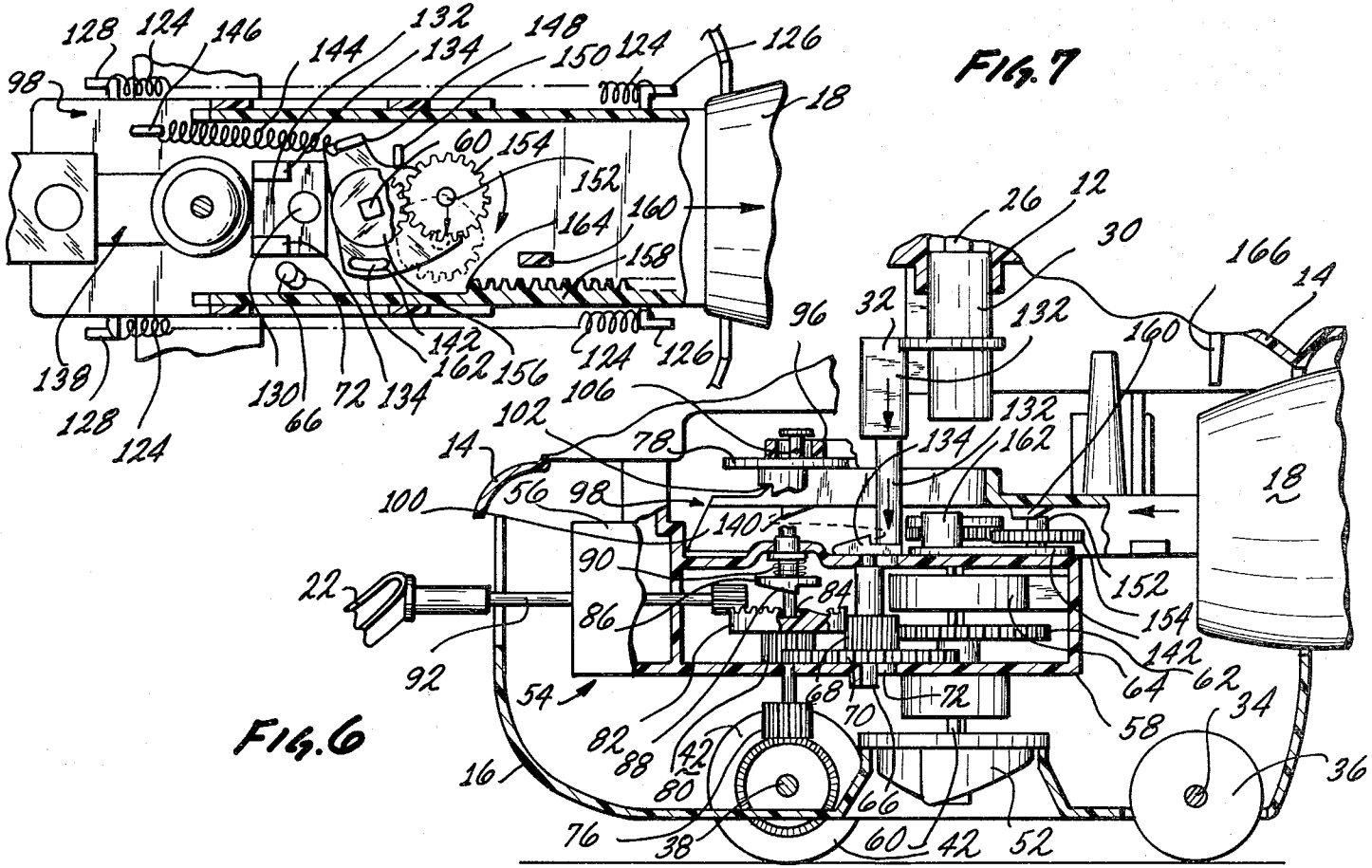
FIG. 6 is a side elevational view in partial section taken about the line 6—6 of FIG. 5 and it shows certain of the components shown in FIG. 4 except they are shown in a different spatial relationship.
FIG. 7 is a plan view of certain of the components of the invention taken at the line 7—7 of FIG. 4.

Concurrently with movement of the legs 24 the rear wheels 40 and 42 are caused to rotate driving the toy 10 forward if it is on a surface. If the toy is in water it, of course, will be driven forward by the motion of tail 22. The legs 24 and the wheels 40 and 42 will continue to move until such time as the small turtle 12 is depressed toward the upper housing 14. When the small turtle 12 is depressed, the head 18 retracts from its extended position to a retracted position as shown in FIGS. 1, 2 and 6 and motion of the legs 24 and the rear wheels 40 and 42 ceases. When the head 18 is totally retracted it automatically reverses its motion and then moves toward its extended position. When it once again reaches its extended position the legs 24 and the rear wheels 40 and 42 again begin their movement and will remain activated until the small turtle 12 once again is depressed. This motion can be repeated as long as the spring motor remains activated.

Mounted within the interior of the toy 10 is a housing 54 composed of a complex upper member 56 and an equally complex lower member 58. An axle 60 extends from winding knob 52 upwardly through lower member 58, upper member 56, and beyond upper member 56 for a short distance. The axle 60 is appropriately journaled in the upper and lower members 56 and 58. A large spur gear 62 is located about axle 60 just above the surface of lower member 58. Above spur gear 62 about axle 60 is a coil spring 64 which serves as the motor of the toy. One end of coil spring 64 is fixedly attached to housing 54 and the other end is fixedly attached to axle 60. Spur gear 62 is also fixedly attached to axle 60 and thus rotates with it.

Positioned next to spur gear 62 is an axle 66 which has a pinion 68 and a spur gear 70 fixedly attached thereto. Axle 66 is journaled in identical slots collectively identified by the numeral 72 in upper and lower members 56 and 58. This allows axle 66, pinion 68 and spur gear 70 attached thereto to move in respect to other components within the housing 54. Pinion 68 is in constant mesh with spur gear 62 and therefore receives the rotary motion inputted to axle 60 by coil spring 64 via spur gear 62.

An axle 74 is journaled in both upper and lower members 56 and 58 and is positioned to the rear of and in line with axle 60. Fixedly attaching to axle 74 below lower member 58 is pinion 76. Fixedly attaching to axle 74 above upper member 56 is crank disk 78. Freewheeling about axle 74 between upper and lower members 56 and 58 is a combination gear (not separately numbered) having a pinion 80 and a crown gear 82. Formed inside of the crown gear 82 are two ratchet teeth collectively identified by the numeral 84. A disk 86 having two ratchet teeth collectively identified by the numeral 88 as is best seen in FIG. 6 is fixedly mounted to axle 74 directly above ratchet teeth 84. A spring 90 placed around axle 74 between disk 86 and upper member 56 biases disk 86 downwardly and since disk 86 is fixedly attached to axle 74 it also biases axle 74, pinion 76 and crank disk 78 downwardly.

When axle 66 is located in slot 72 in the position shown in FIG. 5 spur gear 70 meshes with pinion 80. When axle 66 slides in slots 72 away from the position shown in FIG. 5 spur gear 70 disengages pinion 80. When the coil spring 64 is tensioned by turning winding knob 52 pinion 68 is carried along spur gear 62 moving axle 66 in slots 72 into a position which disengages spur gear 70 from pinion 80. This allows the winding up or tensing of coil spring 64 without communication of its winding motion to pinion 80. After the winding is complete the tension in coil spring 64 tends to bias spur gear 62 in the opposite direction, i.e., clockwise when viewed from above as in FIG. 5 the motion of spur gear 62 is transferred to axle 66 and biases it toward its position in slots 72 shown in FIG. 5 which engages spur gear 70 with pinion 80. Thus, the function of slots 72 is one of a clutch allowing the spring 64 to be coiled without transferring the coiling motion to other components but allowing the uncoiling motion to be transferred.

Tail 22 is mounted to shaft 92 which is appropriately journaled in housing 54. On the other end of shaft 92 is a pinion 94 which engages the crown teeth 82. Thus, any motion of pinion 80 is transferred to tail 22. Pinion 76 engages the crown teeth on gear 44 and thus any motion of axle 74 is transferred to the rear wheels 40 and 42. Crank disk 78 is linked to a crank follower 96 as explained more fully hereafter and thus motion of axle 74 is also transferred to crank follower 96.

As noted previously head 18 is a part of movable member 20. Movable member 20 is slidably mounted on the upper surface of upper member 56 of housing 54. Near end 98 of movable member 20 which is the end opposite wherein head 18 is located a flange 100 extends on the surface of movable member 20 in a U shaped manner as can be seen in FIG. 2. The two identical ends of the flange 100 form identical wedge surfaces 102 as can be seen in FIG. 6. The flange 100 is positioned around axle 74 when the head 18 is in its retracted position as shown in FIG. 6. In this position crank disk 78 is located above flange 100. When the head 18 is in its extended position the flange 100 is moved from beneath crank disk 78 which allows crank disk 78, axle 74, disk 86 and pinion 76 to move downwardly. This causes ratchet teeth 88 to intermesh with ratchet teeth 84 allowing transfer of the motion of pinion 80 to axle 74 which in turn rotates pinion 76 and crank disk 78.

Figure 8:
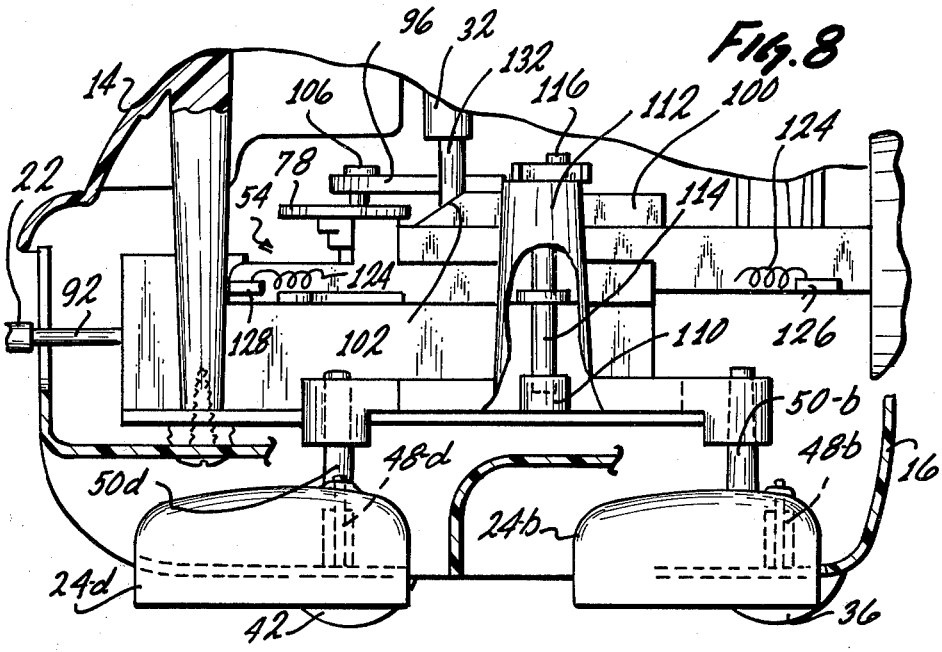
FIG. 8 is a side elevational view in partial section of the central and bottom portions of the invention shown in FIG. 1.

Crank follower 96 is an extension of left side leg member 104. A crank pin 106 extends upwardly from crank disk 78 and engages slot 108 in crank follower 96. Left leg member 104 is journaled in a boss (not shown or numbered) but which is extremely similar to a boss 110 in which right leg member 112 is journaled via shaft 114. This is shown in FIG. 8. A pin 116 extends upwardly from left leg member 104 and engages in a slot 118 formed in right leg member 112. The motion of crank disk 78 is transferred by crank pin 106 to the left leg member 104 and this motion in turn is transferred to the right leg member 112 by the interaction of pin 116 in slot 118. The bosses 50 *a, b, c* and *d* fit into slots 120 *a, b, c* and *d* formed in the right and left leg members 112 and 104 causing the motion of crank disk 78 to be transferred to legs 24.

Projecting upwardly from the upper surface of movable member 20 is a centering member 122. When the head 18 is in its fully retracted position the centering member 122 contacts the right and left leg members 112 and 104 at a point approximately in line with pin 116 and depresses this contact point toward the rear end of the toy 10. This causes the left and right leg members 104 and 112 to be positioned in the position shown in FIG. 2 such that they in turn cause the legs 24 to be pulled into the bottom housing 16 in the position shown in FIG. 2. Thus, any time the head 18 is in the retracted position the crank disk 78 is elevated by the flange 100 severing the connecting between the ratchet teeth 84 and 88 which discontinues any movement of the left and right leg members 104 and 112 and allows them to be locked into the position shown in FIG. 2 by the centering member 122. Together shaft 74 and the parts attached thereto, including crank 78, as well as the left and right leg members 106 and 112, respectively, and their component parts thereof, constitute a motion activation means. These components, as explained above, are inhibited from moving by the centering member 122 when the head 18 is in the retractive position.

Two springs collectively identified by the numeral 124 are located on the right and left hand side of movable member 20. They are held by two L shaped pins 126 integrally formed on the right and left side, respectively, of movable member 20 at one end and at the other end by two identical pins 128 integrally formed on the right and left hand side of housing 54. The springs 124 bias the movable member 20 rearward toward the tail end of the toy 10.

A shaft 130 extends upwardly from upper member 56 near the center of housing 54. A slidable member 132 having two ratchet teeth collectively identified by the numeral 134 fits over shaft 130. Interspaced around shaft 130 between upper member 56 and slidable member 132 is a compression spring 136 which biases slidable member 132 upwardly. Finger 32 attaching to sleeve 30 and communicating with small turtle 12 abuts against slidable member 132 such that the motion of small turtle 12 is ultimately transferred to slidable member 132 depressing slidable member 132 against spring 136 on the shaft 130.

A slot 138 is formed inside of U shaped flange 100 on movable member 20. This slot 138 allows movable member 20 to slide by shaft 130 as well as axle 74. Integrally formed with slidable member 130 on the side of slot 138 are two ratchet teeth collectively identified by the numeral 140. These ratchet teeth 140 are positioned to interact with ratchet teeth 134 on slidable member 132. The interaction of ratchet teeth 140 with ratchet teeth 134 prevents movable member 20 and thus head 18 from being retracted by the bias of spring 124 from the extended position to the retracted position until small turtle 12 is depressed. Upon depressing small turtle 12 its motion is communicated to slidable member 132 causing it to descend to allow ratchet teeth 134 to drop down from their engagement with ratchet teeth 140. When this engagement is broken movable member 20 can slide to the rear of the toy 10 under the bias of spring 124. FIG. 4 shows the engagement of the ratchet teeth 134 and 140 when the head 18 is in the extended position and FIG. 6 shows slidable member 132 in its depressed position with the disengagement of the ratchet teeth 134 and 140.

As seen in FIG. 7 located on the upper surface of movable member 20 is a pivotable member 142. It is located around axle 60 but is free to pivot about axle 60 independent of any movement of axle 60. A spring 144 is attached to one end of an L shaped pin 146 which projects upwardly from upper member 56. The other end of spring 144 is attached to an L shaped pin 148 formed on pivotable member 142. The action of spring 144 biases pivotable member 142 in a counterclockwise manner until it abuts against stop 150. A small boss 152 projects upwardly from the surface of pivotable member 142. A spur gear 154 is freewheeling about boss 152. A second spur gear 156 is fixedly attached to the top of axle 60 and rotates on the surface of pivotable member 142 in response to rotation of axle 60. Spur gear 154 meshes with spur gear 156 and is thus rotated by it.

On the right hand underneath side of movable member 20 is a gear rack 158. Located adjacent to gear rack 158 again on the underside of movable member 20 is an engagement pin 160. Projecting upwardly on the right hand side of pivotal member 142 is a second engagement pin 162. When the head 18 is in the extended position as is shown in FIG. 7 pivotable member 142 is pulled against stop 150 by spring 144. When small turtle 12 is depressed the head 18 and the movable member 20 start to slide toward the rear of the toy. This engages pin 160 against pin 162. As the movable member 20 further slides the engagement of these two pins causes pivotable member 142 to rotate away from stop 150 until it is in a position corresponding to the position of spur gear 154 as shown in FIG. 7 in phantom. In this position spur gear 154 is meshed with gear rack 158. This happens just when the movable member 20 has reached the end of its travel toward the rear end of the toy 10. Spur gear 154 is rotating counterclockwise via its interaction with spur gear 156 and axle 60. This counterclockwise rotation drives the movable member 20 forward until the head 18 is again in the extended position at which time spur gear 154 reaches the end 164 of gear rack 158. At this point there is no longer any frictional engagement between spur gear 154 and gear rack 158 and thus pivotal member 142 is pulled counterclockwise by spring 144 until it reaches stop 150. Thus upon being retracted from its extended position to its retracted position head 18 automatically is re-extended outwardly by the process thus described.

Extending downwardly from upper housing 14 is a barrier 166. In addition to its function previously described, centering member 122 by interacting with barrier 166 serves to limit the amount of travel of movable member 20 outwardly from the toy 10. When the head 18 is in its fully extended position the centering member 122 has abutted against and is held against further outward travel by barrier 166.

I claim:

1. A toy comprises:

a body;

a movable member located in association with said body said movable member mounted on said body to move between a retracted position wherein said movable member is generally located inside of said body and an extended position wherein at least a portion of said movable member is extended outwardly from said body;

retraction means operatively associated with said movable member for moving said movable member from said extended position to said retracted position, said retraction means including a retraction activation means, said retraction activation means movably mounted on said body and including at least a portion of said retraction activation means being exposed outside of said body;

retaining means operatively associated with said retraction activation means and alternately associated with said movable member and disassociated with said movable member, said retaining means capable of in a first instance associating with said movable member retaining said movable member in said extended position and in a second instance disassociating from said movable member so as not to retain said movable member in said extended position;

said exposed portion of said retraction activation means capable of being stimulated by the operator of said toy and when stimulated disassociating said retaining means from said movable member causing said retraction means to move said movable member from said extended position to said retracted position;

automatic extension means operatively associated with said movable member and capable of detecting when said movable member is in said retracted position and in response to said movable member being in said retracted position to automatically move said movable member back to said extended position and reassociate said retaining means with said movable member.

2. The toy of claim 1 including:

motor located inside of said body and operatively connected to said automatic extension means.

3. The toy of claim 2 including:

at least one motion means movably attached to said body and capable of moving with respect to said body;

motion activation means operatively connected to said motor and capable of causing said movement of said motion means when said movable member is in said extended position and capable of inhibiting movement of said motion means when said movable member is in said retracted position.

4. The toy of claim 3 wherein:

said motion means includes rolling means at least a portion of which is exposed outside of said body, said rolling means capable of supporting at least a portion of said body above a surface and propelling said body along said surface.

5. The toy of claim 3 wherein:

said motion means includes at least one auxiliary movable member attaching to said body and capable of moving reciprocally between a first position and a second position.

6. The toy of claim 4 wherein:

said motion means includes at least one auxiliary movable member attaching to said body and capable of moving reciprocally between a first position and a second position.

7. The toy of claim 6 wherein:

said body includes a bottom surface having a portion of at least one freewheeling wheel which is attached to said bottom surface exposed below said bottom surface and supporting a portion of said body above said surface;

said rolling means comprises a set of driving wheels at least a portion of which is exposed below said bottom surface, said driving wheels supporting the remainder of said body above said surface and capable of driving said body along said surface.

8. The toy of claim 3 wherein:

said body includes an internal support surface, said motor attaching to said internal support surface;

said movable member slidably mounted on said internal support surface;

a first gear means operatively attached to said movable member, a second gear means movably mounted on said internal support surface between a position wherein said first and said second gear means are capable of interacting with each other and a position wherein said first and said second gear means do not interact with each other;

meshing means located in association with both said movable member and said internal support surface and capable of moving said second gear means into said position wherein said first and said second gear means interact with each other;

said second gear means operatively associated with said motor so as to be driven by said motor.

9. The toy of claim 8 wherein:

said retraction means comprises a biasing means operatively attaching between said movable member and said internal support surface and biasing said movable member from said extended position toward said retracted position;

said retaining means when associated with said movable member capable of inhibiting the force of said biasing means.

10. The toy of claim 3 including:

a clutch means interposed between said motion activation means and said motor and capable of reversably completing and breaking said connection between said motion activation means and said motor.

11. The toy of claim 10 wherein:

said motion means includes rolling means at least a portion of which is exposed outside of said body, said rolling means capable of supporting at least a portion of said body above a surface and propelling said body along said surface;

said motion means includes at least one auxiliary movable member attaching to said body and capable of moving reciprocally between a first position and a second position.

12. The toy of claim 9 including:

a clutch means interposed between said motion activation means and said motor and capable of reversibly completing and breaking said connection between said motion activation means and said motor;

and wherein said motion means includes rolling means at least a portion of which is exposed outside of said body, said rolling means capable of supporting at least a portion of said body above a surface and propelling said body along said surface;

said motion means includes at least one auxiliary movable member attaching to said body and capable of moving reciprocally between a first position and a second position.

* * * * *